US011745232B2

(12) United States Patent
Drocco

(10) Patent No.: US 11,745,232 B2
(45) Date of Patent: Sep. 5, 2023

(54) APPARATUS FOR WASHING CONTAINERS

(71) Applicant: DROMONT S.p.A., Grinzane Cavour (IT)

(72) Inventor: Luca Drocco, Alba (IT)

(73) Assignee: DROMONT S.p.A., Grinzane Cavour (IT)

( * ) Notice: Subject to any disclaimer, the term of this patent is extended or adjusted under 35 U.S.C. 154(b) by 163 days.

(21) Appl. No.: 17/201,549

(22) Filed: Mar. 15, 2021

(65) Prior Publication Data

US 2021/0291240 A1 Sep. 23, 2021

(30) Foreign Application Priority Data

Mar. 17, 2020 (IT) ..... 102020000005647

(51) Int. Cl.
*B08B 9/093* (2006.01)
*B05B 3/00* (2006.01)
*B05B 3/02* (2006.01)

(52) U.S. Cl.
CPC ..... *B08B 9/0936* (2013.01); *B05B 3/00* (2013.01); *B05B 3/02* (2013.01)

(58) Field of Classification Search
CPC ..... B08B 9/0936
USPC ..... 134/167 R
See application file for complete search history.

(56) References Cited

U.S. PATENT DOCUMENTS 5,579,787 A * 12/1996 Wood ..... B08B 9/0936 239/246
7,300,000 B2 * 11/2007 Kitamura ..... B05B 7/0441 239/263.1
2004/0089329 A1 5/2004 Bijster
2018/0281032 A1 10/2018 Kitamura et al.

FOREIGN PATENT DOCUMENTS

CN 107088567 A * 8/2017 ..... B08B 9/0808
CN 107159404 A * 9/2017 ..... B02C 18/08
CN 108672431 A 10/2018
FR 2289249 A1 5/1976
JP H05138139 A 6/1993
JP H05305273 A 11/1993
JP H1157643 A 3/1999

OTHER PUBLICATIONS

CN 107159404—Machine Translation (Year: 2017).*
CN 107088567—Machine Translation (Year: 2017).*
Italian Search Report dated Dec. 8, 2020. 27 pages.

* cited by examiner

*Primary Examiner* — Marc Lorenzi
(74) *Attorney, Agent, or Firm* — RMCK Law Group PLC

(57) ABSTRACT

An apparatus for washing containers includes a support intended to be applied onto the upper edge of a container, a translating unit movable inside the container between a raised position and a lowered position, a rotating element carried by the translating unit and carrying a plurality of nozzles, and an actuation device including a vertical driving screw that controls the movement in the vertical direction of the translating unit and the rotation of the rotating member.

7 Claims, 5 Drawing Sheets

APPARATUS FOR WASHING CONTAINERS

CROSS-REFERENCE TO RELATED APPLICATION

This application claims priority to Italian Patent Application No. 102020000005647 filed Mar. 17, 2020. The disclosure of the above application is incorporated herein by reference in its entirety.

FIELD OF THE INVENTION

The present invention relates to an apparatus for washing containers.

The invention was developed in particular with a view to its application in the industry sector for preparing and dosing paints and related products. In the following description, reference will be made to this specific application field without, however, losing generality.

DESCRIPTION OF THE PRIOR ART

The production processes of paints, dyes and the like involve the use of large cylindrical stainless steel containers with an open upper edge, which can be fixed or movable on wheels according to the type of machine used. Preparing paints, dyes or the like involves dosing and mixing operations that are carried out inside these containers. At the end of each production batch it is necessary to proceed with the washing and sanitizing of the process containers. For these operations, washing machines or cleaning stations are used, which carry out washing of the inner surfaces of the containers by means of a washing head equipped with nozzles that emit jets of washing liquid at high pressure. The washing head is moved inside the container to strike the entire side surface and bottom wall of the container with the jets of washing liquid.

The washing apparatuses currently on the market are of different types. In view of their effectiveness, the most widespread washing apparatus are equipped with rotating washing heads, with two rotation axes and four outlet channels. A nozzle is mounted on each outlet channel, which produces a thread-like jet of the washing fluid, which imparts a predetermined pressure value to the jet.

The washing apparatuses according to the prior art are affected by the following drawbacks:

- the thread-like jet emitted by the nozzles has a very high pressure density: this makes the jet very effective but the repetition of the jet on the same areas risks leaving grooves or incisions on the side wall of the container, which may involve the risk of having to replace the container,
- the rotation of the washing head around two axes causes the thread-like jet to draw net-shaped paths on the side walls of the containers; this requires the washing head to perform many rotation cycles to effectively wash the entire side wall of a container;
- the high number of passages required by known rotating heads entails a long duration of the washing cycle, an extensive use of the equipment and a high consumption of washing liquid (water or solvent);
- if the rotating head is positioned in the center of the cylindrical container, the thread-like jet has a loss of pressure as the distance from the side wall increases, and this implies that the jet loses a part of its washing action at the side surface of the container;

- the very high operating pressures necessary to make the washing jets effective require large pumps capable of guaranteeing high flow rates and pressures;
- to cover the entire inner surface of the containers vertically, the arm that supports the washing head must have a vertical stroke activated by an electric or pneumatic system, which entails additional costs for inserting these devices (also taking into account complications of the ATEX directive in the case of using solvents as washing liquids).

OBJECT AND SUMMARY OF THE INVENTION

The object of present invention is to provide a washing apparatus that overcomes the problems of the apparatuses according to the prior art.

According to the present invention, this object is achieved by a washing apparatus having the characteristics forming the subject of claim 1.

The claims form an integral part of the disclosure provided here in relation to the invention.

The apparatus according to the present invention provides a washing solution with a helical trajectory that, with a single motor, carries out both the vertical movement and the rotary movement of the equipment that supports the washing nozzles.

According to one embodiment, the apparatus according to the present invention is equipped with nozzles that emit a triangular-shaped jet with an opening angle greater than 60°. This shape of the washing jet allows a band with a size of several centimeters to be covered. A triangular blade with a wide opening acts on the wall to be washed instead of a single thread-like jet.

As will become clear from the following detailed description, the apparatus according to the present invention offers the following advantages:

- possibility to adjust the rotation speed and, consequently, the advancing/rotation speed of the washing system, which allows flexible management of the intensity of the washing action of the nozzles,
- washing carried out by means of a triangular blade with a wide opening instead of a thread-like jet,
- lower consumption of washing liquid,
- washing equipment (pumps, pipes, etc.) which are undersized compared to machines of the same size and performance due to the fact that they require much lower pressure values.

BRIEF DESCRIPTION OF THE DRAWINGS

The present invention will now be described in detail with reference to the attached drawings, given purely by way of non-limiting example, wherein.

DETAILED DESCRIPTION

Figure 1:
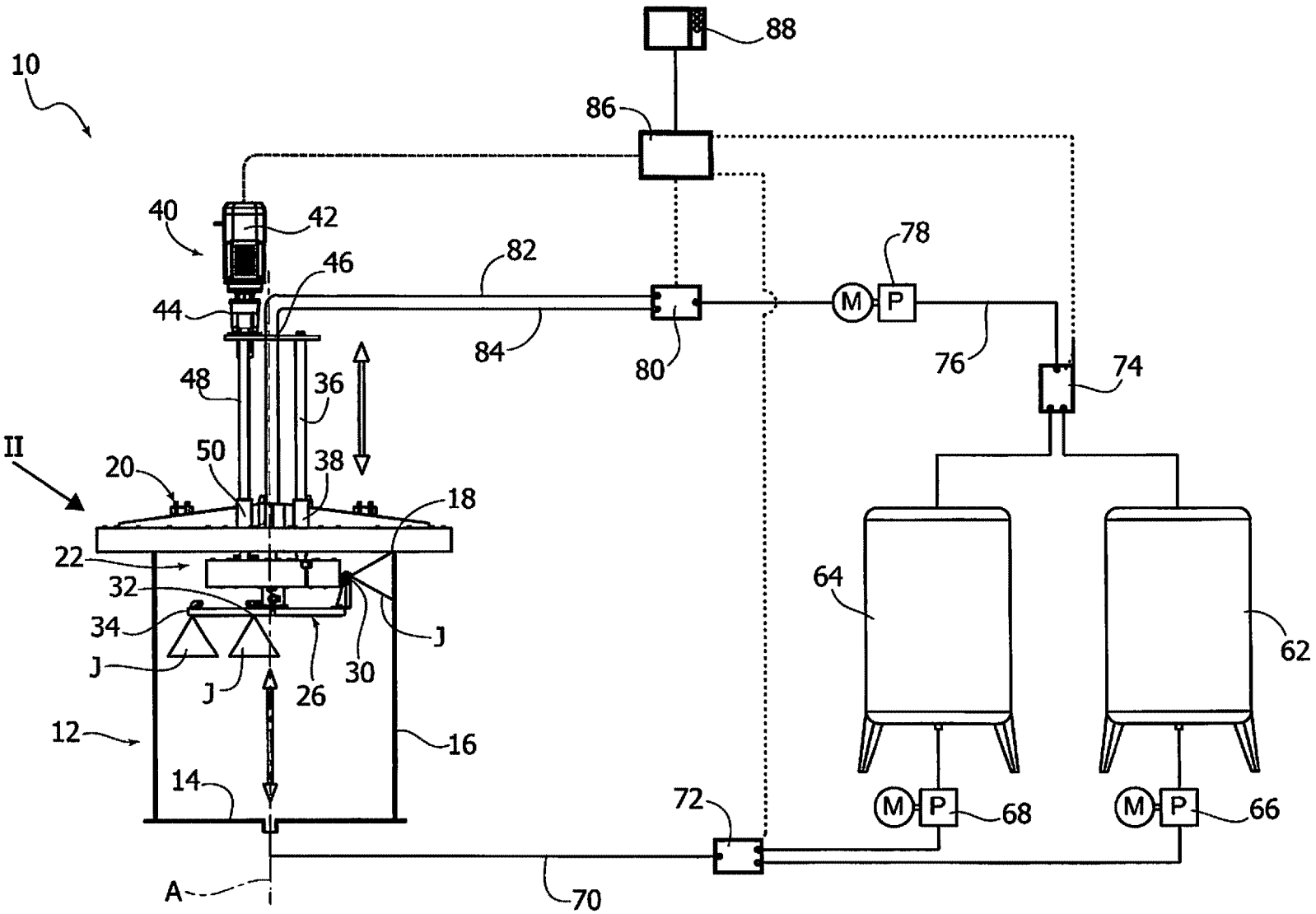
FIG. 1 is a diagram of an apparatus according to the present invention.

With reference to the Figures, numeral 10 indicates an apparatus for washing containers 12. The apparatus 10 is configured to carry out the washing of large stainless steel containers used as process tanks in machines or plants for preparing paints, dyes and the like. Each of the containers 12 has a horizontal bottom wall 14, a cylindrical side wall 16 and an open upper edge 18.

The apparatus 10 comprises a support 20 having substantially the shape of a discoidal plate. During use, the support 20 is placed as a cover on the upper edge 18 of the container 12 as illustrated in FIGS. 1, 2 and 3.

Figure 6:
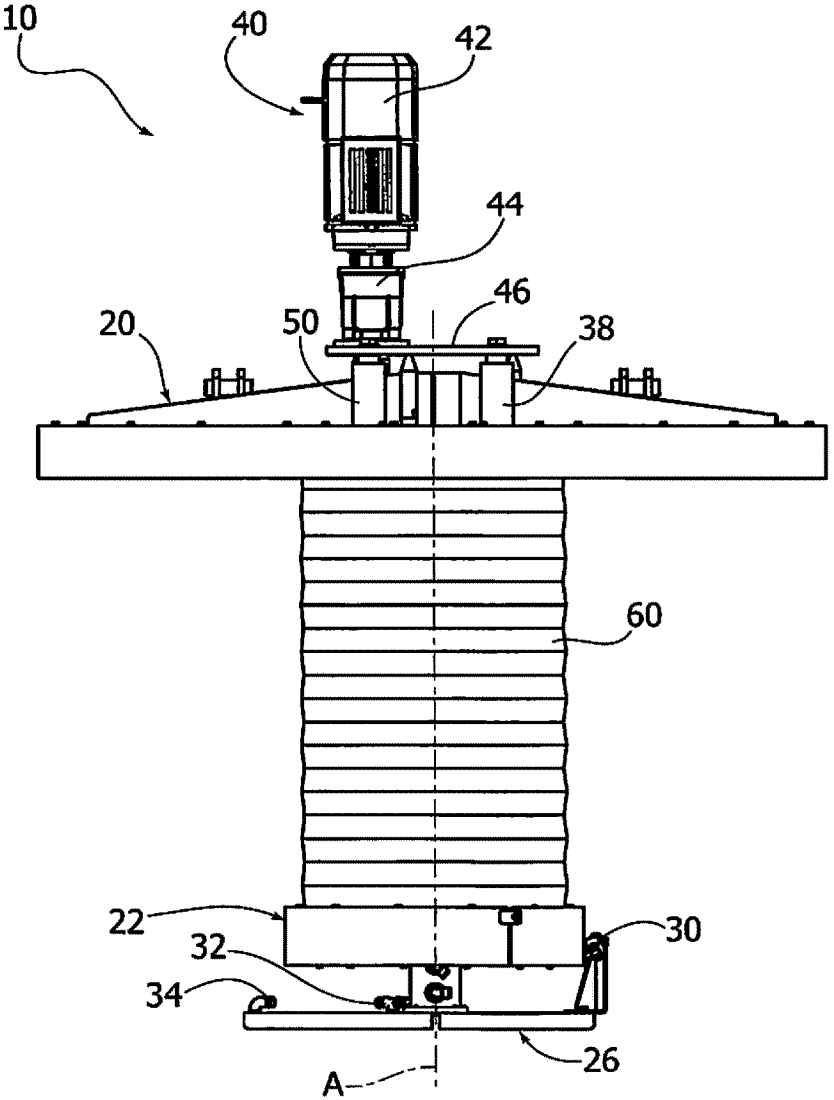
Figure 5:
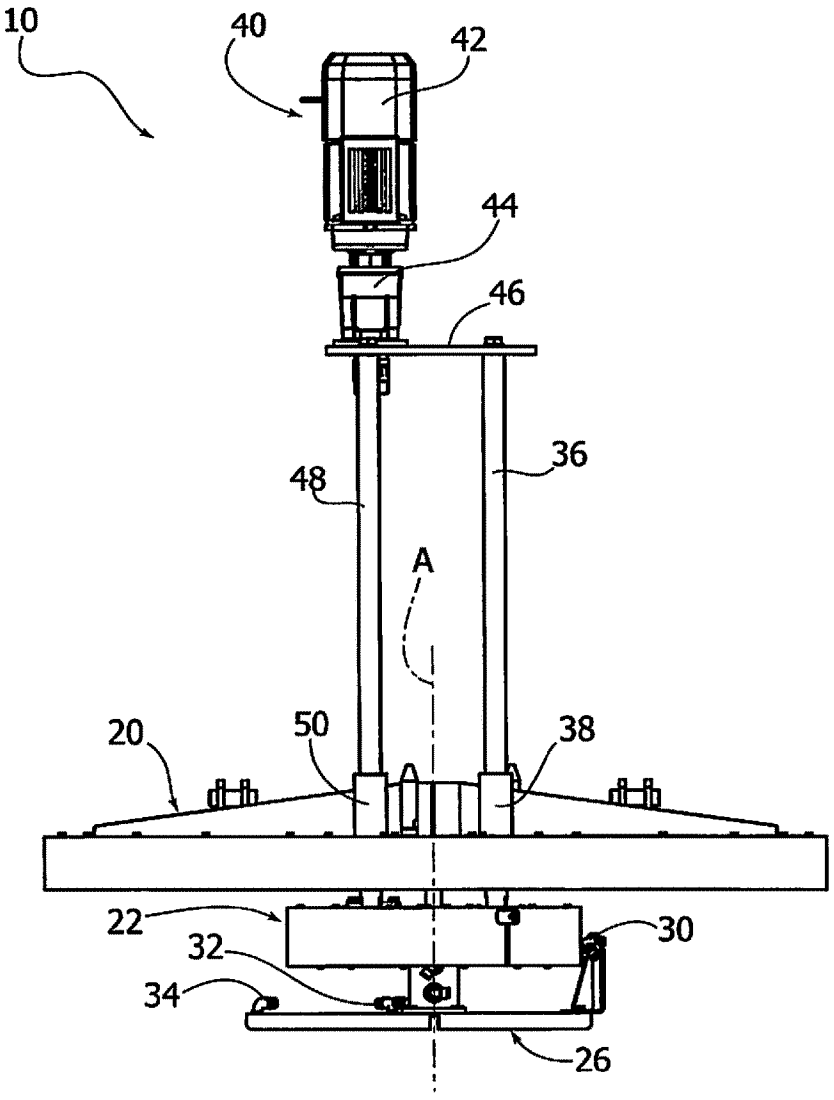

The apparatus 10 comprises a translating unit 22, which is movable with respect to the support 20 along a vertical axis A between a raised position illustrated in FIG. 5 and a lowered position illustrated in FIG. 6.

Figure 3:
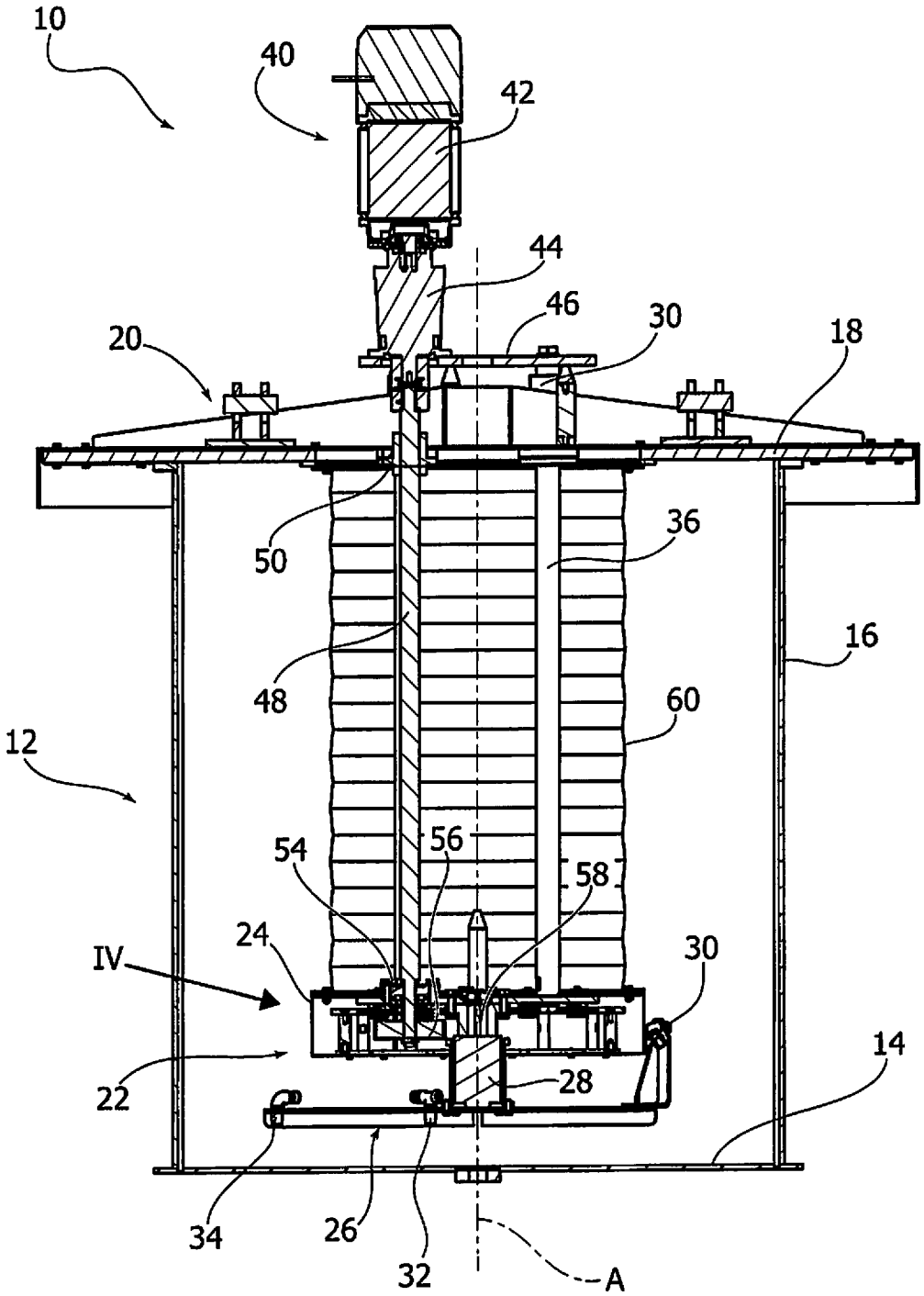
FIG. 3 is a cross-section along the line III-III of FIG. 2.
Figure 4:
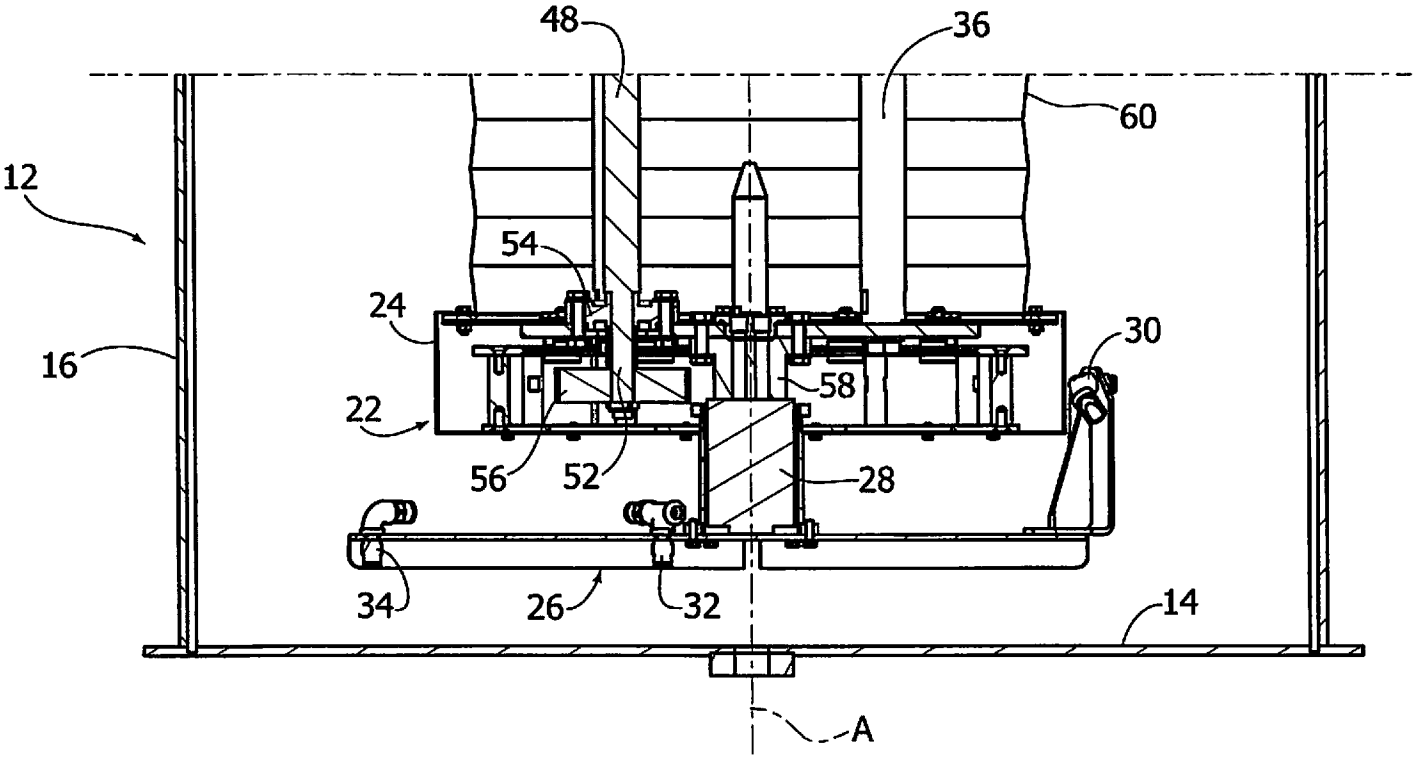
FIG. 4 is a cross-section on an enlarged scale of the part indicated by the arrow IV in FIG. 3, and FIGS. 5 and 6 are side views illustrating the apparatus in two working positions.

With reference, in particular, to FIGS. 3 and 4, the translating unit 22 comprises an outer casing 24 that is internally hollow. The translating unit 22 carries a rotating element 26 which is rotatably mounted with respect to the translating unit 22 around the vertical axis A by means of a central hub 28. The rotating element 26 carries a plurality of nozzles 30, 32, 34, which emit respective jets of pressurized washing fluid. The nozzles 30, 32, 34 are connected to a washing liquid supply circuit by means of an independent two-way rotating connector housed in the hub 28.

Figure 2:
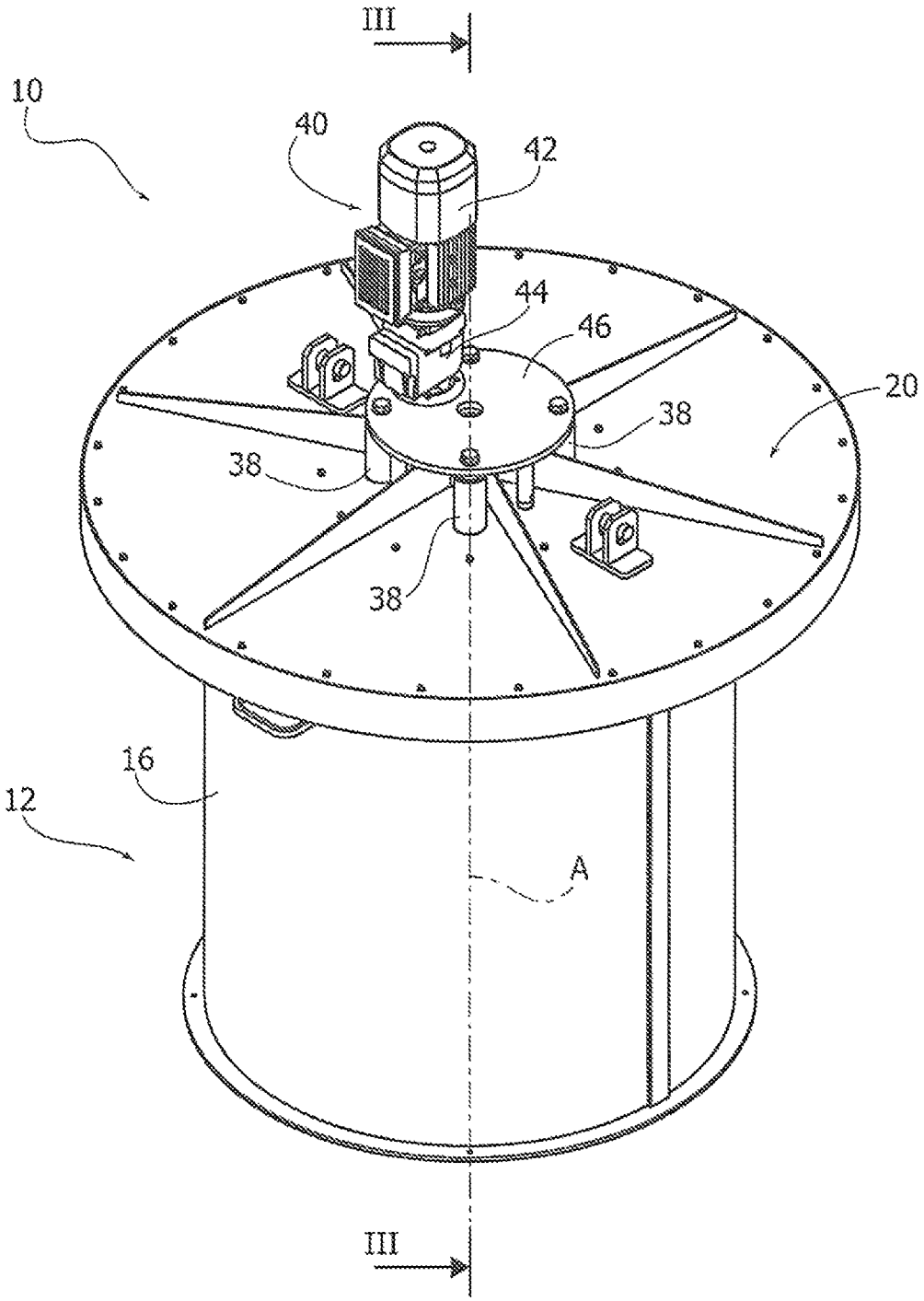
FIG. 2 is a perspective view of the part indicated by the arrow II in FIG. 1.

As illustrated schematically in FIG. 1, each of the nozzles 30, 32, 34 emits a respective jet of liquid J with a triangular shape and, preferably, having an opening angle greater than 60°. The jet J emitted by the nozzle 30 is directed towards the side wall 16 of the container 12 and the jets J emitted by the nozzles 32, 34 are directed towards the bottom wall 14.

The translating unit 22 is connected to the support 20 by means of at least one guide column 36 parallel to the vertical axis A. In a possible embodiment, the apparatus 10 comprises four guide columns 36 parallel to each other. The guide column 36 or each guide column 36 has a lower end fixed to the translating unit 22, and slidably engages a respective through-sleeve 38 carried by the support 20. The connection of the translating unit 22 to the support 20 by means of one or more guide columns 36 allows the translating unit 22 to move with respect to the support 20 in the direction of the axis A, but prevents a rotation of the translating unit 22 around the axis A. In its raised position, the translating unit 22 is very close to the support 20, and the guide column 36 (or the guide columns 36) extends almost completely above the support 20.

The apparatus 10 comprises a single motor unit 40, which controls both the movement of the translating unit 22 along the axis A between the raised position and the lowered position and vice versa, and the rotation of the rotating element 26 around the axis A. The motor unit 40 may comprise an electric motor 42 and a gear reducer 44. The motor unit 40 is carried by a plate 46 fixed to the upper end of the guide column 36 or the guide columns 36. The motor unit 40 is connected to a driving screw 48 parallel to the vertical axis A. The driving screw 48 engages a nut 50 fixed with respect to the support 20. With reference to FIGS. 3 and 4, the driving screw 48 has a non-threaded lower end 52, which is axially fixed and freely rotatable with respect to the translating unit 22. For example, the lower end 52 of the driving screw 48 may be connected to the casing 24 of the translating unit 22 by means of a bearing 54. The lower end 52 of the driving screw 48 extends inside the translating unit 22, and is connected to the hub 28 of the rotating element 26 by means of a gear transmission comprising, for example, a first gear 56 fixed with respect to the driving screw 48 and a second gear 58 fixed with respect to the hub 28 of the rotating element 26. The two gears 56, 58 can mesh directly with each other or they can be connected to each other by means of other gears.

With reference to FIGS. 3, 4 and 6, the apparatus 10 may comprise a tubular bellows 60 having an upper end fixed to the support 20 and a lower end fixed to the translating unit 24. The tubular bellows 60 surrounds the driving screw 48 and the guide column 36 or the guide columns 36, and has the object of protecting these elements from splashes of washing liquid. The tubular bellows 60 extends or compresses during the downward or upward movement of the translating unit 22.

With reference to FIG. 1, showing one of the many possible plant executions, the apparatus 10 comprises a first tank 62 for the initial washing liquid, and a second tank 64 with the rinsing liquid, connected to respective pumps 66, 68. A duct 70 is connected to a drain hole of the container 12. A first three-way valve 72 sends the liquid coming from the container 12 towards the first tank 62 or towards the second tank 64 according to the degree of contamination of the liquid. A second three-way valve 74 selectively connects a washing liquid supply duct 76 to the first tank 62 or to the second tank 64. A washing liquid supply pump 78 pressurizes the washing liquid and sends it to a third three-way valve 80. At the outlet of the valve 80, the pressurized liquid is sent to a first duct 82 connected to the side nozzle 30 or to a second duct 84 connected to the bottom nozzles 32, 34.

A control unit 86 controls the motor unit 40 and the three-way valves 72, 74, 80. The control unit 86 can be operated or programmed via a user interface 88.

During operation, the support 20 is positioned on the upper edge 18 of a container 12 to be washed, with the translating unit 22 in the raised position. The washing liquid is fed to the side nozzle 30 only. The motor unit 40 is operated to control, by means of the driving screw 48, the movement from top downwards of the translating unit 22. While the translating unit 22 moves from the top downwards, the rotating element 26 carrying the nozzles 30, 32, 34 rotates around the axis A. The jet J of washing liquid emitted by the side nozzle 30 impacts against the inner surface of the side wall 16 of the container 12, and follows a helical trajectory. When the translating unit 22 is close to the fully lowered position, the supply of washing liquid to the side nozzle 30 is interrupted, and the washing liquid is fed to the bottom nozzles 32, 34. The jets J of washing liquid produced by the bottom nozzles 32, 34 strike the bottom surface 14 of the container 12 and, following the rotation of the rotating element 26, follow a circular trajectory on the bottom wall 14. The bottom nozzles 32, 34 wash the entire bottom wall 14 after a 360° rotation of the rotating element 26. The washing liquid is taken from the bottom of the container 12 and is sent to one of the two tanks 62, 64 through the duct 70 and the three-way valve 72.

The control unit 86 can adjust the rotation speed of the motor unit 40 and, consequently, the advancement/rotation speed of the washing system. This allows the intensity of the washing action of the nozzles to be managed with a certain flexibility. Thanks to the triangular jets, the nozzles 30, 32, 34 cover the entire inner surface of the container 12 with a single top-down stroke of the translating unit 22. This allows a rapid washing cycle and a lower consumption of washing liquid to be obtained. The jets of washing liquid may have a relatively low pressure with respect to the solutions according to the prior art, which allows the use of pumps, valves and pipes with lower nominal pressures and flow rates, with consequent advantage from the point of view of costs.

Of course, without prejudice to the principle of the invention, the details of construction and the embodiments can be widely varied with respect to those described and illustrated, without thereby departing from the scope of the invention as defined by the claims that follow.

The invention claimed is:

1. An apparatus for washing containers comprising:

a support configured to be placed on an open upper edge of a container, a translating unit movable with respect to the support inside the container along a vertical direction between a raised position and a lowered position, a rotating element rotatably carried by the translating unit, wherein the rotating element carries at least one first nozzle arranged to emit a jet of washing liquid directed onto an inner side surface of the container and at least one second nozzle arranged to emit another jet of washing liquid directed onto a horizontal bottom surface of the container, a motor unit that rotates a driving screw that extends along the vertical direction, wherein the driving screw engages a nut fixed with respect to the support, wherein the driving screw has a lower end that is axially fixed and freely rotatable with respect to the translating unit, and wherein the lower end of the driving screw is connected to the rotating element through a gear transmission.

2. The apparatus of claim 1, wherein the translating unit is connected to the support by at least one guide column, which extends along the vertical direction and which slidably engages a respective through-sleeve carried by the support.

3. The apparatus of claim 2, wherein said motor unit is carried by a plate fixed to the upper end of said at least one guide column.

4. The apparatus of claim 2, wherein the at least one guide column includes four guide columns, and wherein said translating unit is connected to the support by the four guide columns, which are parallel to each other.

5. The apparatus of claim 1, comprising a tubular bellows having a lower end fixed to said translating unit and an upper end fixed to said support.

6. The apparatus of claim 1, wherein each of said at least one first and second nozzles emits a jet of washing liquid with a triangular shape.

7. The apparatus of claim 6, wherein each of said jets of washing liquid has an opening angle greater than 60°.

* * * * *